United States Patent [19]

Walker

[11] 4,195,676

[45] Apr. 1, 1980

[54] WHEELED BRIEFCASE

[76] Inventor: Brooks Walker, 1280 Columbus Ave., San Francisco, Calif. 94133

[21] Appl. No.: 961,383

[22] Filed: Nov. 16, 1978

[51] Int. Cl.[2] ..... A45C 3/02

[52] U.S. Cl. ..... 150/1.6; 190/18 A

[58] Field of Search ..... 150/1.6; 190/18 A

[56] References Cited

U.S. PATENT DOCUMENTS 2,921,615 1/1960 Kilik ..... 150/1.6

FOREIGN PATENT DOCUMENTS 1563534 4/1969 France ..... 190/18 A

*Primary Examiner*—Donald F. Norton

*Attorney, Agent, or Firm*—Gordon Wood

[57] ABSTRACT

A briefcase or like article having accordian folds or pleats forming its bottom wall is provided with wheels attached to said bottom wall so as not to interfere excessively with the expansion or contraction of the width of the bottom wall through the action of the pleats or folds. A wheel mount is clamped to one side of the briefcase and to an adjacent fold of the accordian-like bottom wall.

4 Claims, 5 Drawing Figures

WHEELED BRIEFCASE

This invention relates to carriers such as suitcases and briefcases having accordian-like bottom walls formed with accordian pleats or folds. Such articles when filled with heavy items may become extremely heavy, and it is therefore the main object of the present invention to provide ground wheels for the same so that such articles may be pulled instead of carried.

Another object of the invention is the provision of ground wheel mounts for a briefcase and like article which may be readily attached by the user or installer without requiring any special skill.

Another object is the provision of wheel mounts for a conventional briefcase which may be attached so as not to interfere to any excessive degree with the expansion or contraction of the bottom wall of the briefcase through the usual folding and unfolding of the accordian pleats in such bottom wall.

Still another object is to mount the wheels with less than one-half of the wheels exposed so as to greatly reduce or eliminate the danger of being knocked off in rough handling.

Other objects and advantages will be apparent from the following specification and from the drawings.

Figure 2:
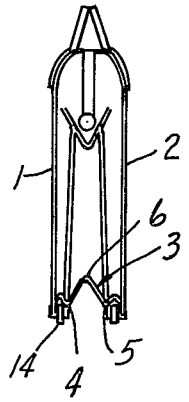
FIG. 2 is an end elevation of the briefcase shown in FIG. 1

The invention is illustrated as used on a conventional briefcase having opposite sides 1, 2 and a bottom wall generally designated 3 which usually includes accordian folds 4, 5 adjacent the sides 1, 2 respectively and a central fold 6 as best seen in FIG. 2 shown in folded position.

The invention comprises an inverted U-shaped downwardly opening channel member having sidewalls 10, 11 (FIG. 3) and an integral top wall 12. Extending between sidewalls 10, 11 is a pin 13 on which is mounted a ground wheel 14. The sidewall 10 is formed with an extension that includes a bottom portion 16 passing under the lower edge of side 1 of the suitcase and a flange 17 extending upwardly along the exterior face of the side 1 of the briefcase. Said flange 17 may be bent inwardly and provided with sharpened points 18 which are adapted to grip the side 1 of the brief case when sidewall 10 and flange 17 are squeezed toward each other by means of pliers or the like.

In a somewhat similar manner sidewall 11 of the wheel mount is formed with a lower portion 20 and an upwardly extending flange 21 which may be provided with a sharpened upper edge 22 adapted to grip the accordian fold 4 when the sidewall 11 and flange 21 are squeezed together.

Figure 5:
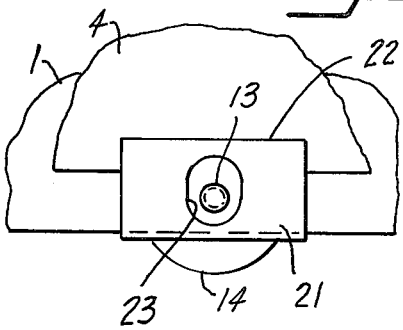
FIG. 5 is a side elevation taken in a plane indicated by lines 5—5 of FIG. 3.

To facilitate assembly flange 21 may be provided with an aperture 23 (FIG. 5) to allow access to the end of pin 13 so as to allow upsetting said end to rivet it to the sidewall 11.

Figure 3:
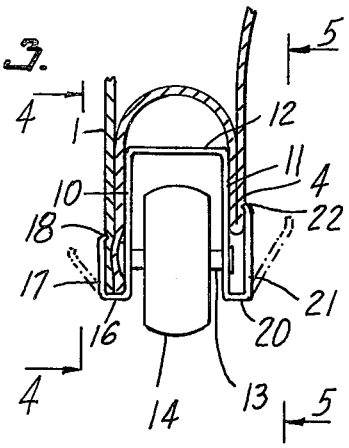
FIG. 3 is an enlarged fragmentary cross section taken through a sidewall and a portion of the bottom wall of a conventional briefcase showing a wheel attached thereto.
Figure 4:
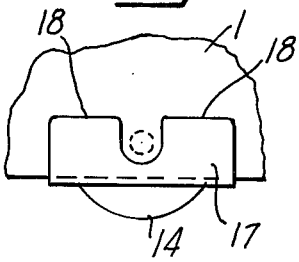
FIG. 4 is a side elevation taken in a plane indicated by lines 4—4 of FIG. 3.

The above described wheel mount may be provided with the flanges 17, 21 swung outwardly to their dot dash positions shown in FIG. 3 so that they may be bent inwardly to their full line gripping positions by means of pliers or the like.

It will be understood that the remaining wheel mounts may be applied in a similar manner with two wheel mounts connected between side 1 and accordian fold 4 and the remaining two wheel mounts connected between side 2 of the briefcase and accordian fold 5 to provide four wheel level travel on a relatively smooth surface.

Figure 1:
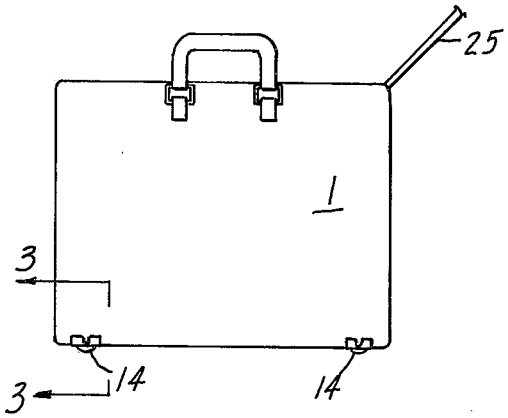
FIG. 1 is a side elevation of a conventional briefcase showing the wheels of the present invention attached thereto.

The briefcase may be drawn along a supporting surface by means of a tether 25 (FIG. 1). A simple tether may be provided by employing an elongated ribbon of fabric or the like which is formed with a knot or provided with a hook at one end so that the briefcase may be closed on the ribbon with the knot or hook preventing the ribbon from being pulled out. Alternatively a pivoted ring or the like may be provided on the suitcase so that the suitcase may be pulled by a leash or tether which can be stored in the case when not in use.

I claim:

1. In a carrier such as a briefcase having a pair of opposed sides and an accordian-like bottom wall formed with a plurality of accordian folds, a wheel mount positioned inwardly of one of said sides and formed with a downwardly opening central channel portion having opposed sidewalls, a wheel rotatably mounted between said sidewalls, one of said sidewalls having an extension passing under the lower edge of said one side of said carrier and upwardly along said one side, the other of said sidewalls having an extension passing under one of said accordian folds and upwardly along said one fold, said one side and said one fold being clamped between said sidewalls and extensions.

2. A structure according to claim 1 wherein the free ends of said extensions are sharpened to grip said side and said fold.

3. A structure according to claim 2 wherein said free ends are turned inwardly of said extension toward said side.

4. A structure according to claim 1 wherein the free ends of said extensions are turned inwardly toward said side and the terminal portion of said free end is sharpened to grip said side.

* * * * *